United States Patent [19]

Burleson

[11] Patent Number: 4,646,652

[45] Date of Patent: Mar. 3, 1987

[54] RAILROAD CAR DOOR BOTTOM GUIDE SYSTEM

[75] Inventor: Robert M. Burleson, Adamsville, Pa.

[73] Assignee: Greenville Steel Car Company, Greenville, Pa.

[21] Appl. No.: 819,408

[22] Filed: Jan. 16, 1986

[51] Int. Cl.[4] ..... B61D 3/02; B60J 5/10

[52] U.S. Cl. ..... 105/378; 16/90; 105/410; 160/201

[58] Field of Search ..... 105/378, 410; 104/242; 49/372, 410, 411; 16/90, 91; 160/196 R, 199, 201, 206

[56] References Cited

U.S. PATENT DOCUMENTS

| | | | |
|---|---|---|---|
| 3,091,004 | 5/1963 | Mays | 49/411 X |
| 3,165,076 | 1/1965 | Adler | 160/201 X |
| 3,756,302 | 9/1973 | Sivin | 49/410 X |
| 3,995,563 | 12/1976 | Blunden | 105/378 |
| 3,996,860 | 12/1976 | Ravani et al. | 105/378 X |
| 4,077,330 | 3/1978 | Peisner et al. | 105/378 X |
| 4,116,135 | 9/1978 | Jaekle et al. | 105/378 |
| 4,437,410 | 3/1984 | Stoller, Sr. et al. | 105/378 |

FOREIGN PATENT DOCUMENTS

| | | | |
|---|---|---|---|
| 322211 | 11/1929 | United Kingdom | 104/242 |

*Primary Examiner*—Randolph A. Reese

*Attorney, Agent, or Firm*—Webb, Burden, Robinson & Webb

[57] ABSTRACT

A railroad car arranged to transport automobiles comprises a floor, a roof, a pair of spaced side walls, at least one door assembly and means for guiding the door assembly to a position adjacent a side wall to enable loading and unloading of the railroad car. A rail secures the lower end of the door assembly, the rail being positioned along the floor of the railroad car. Extensions are attached to the door assembly and are in sliding engagement with the rail. The rail has two interrupted portions through which the tires of an automobile will pass during loading and unloading. The extensions attached to the door assembly are aligned onto the rail after passing through the interrupted portions during opening and closing by a pair of rail segments. The rail segments are spaced at an angle towards the rail and away from the interrupted portions and are attached to the floor at both ends of each interrupted portion. The door assemblies, when in the closed position, are secured at the inerrupted portions by a pin or metal wedge, a correspondingly sized aperture or slit, and means for effecting relative movement therebetween.

8 Claims, 5 Drawing Figures

1
2
3
4
5
5a
5b
5c
5d
5e
5f
5g
6
6a
6b
6c
6d
6e
6f
6g
7
8a
8b
9
10
11
12A
12B
13
14
15
16
17
18
20
21
22
25
26
27

RAILROAD CAR DOOR BOTTOM GUIDE SYSTEM

FIELD OF THE INVENTION

This invention relates to the field of railroad cars adapted to carry automobiles. More particularly, the invention is directed to railroad car door bottom guide systems.

BACKGROUND OF THE INVENTION

For railroad cars adapted to carry automobiles, it is essential that the cargo be enclosed to protect it from theft of components. Such railroad cars are provided with side walls, a roof spanning the side walls and ends that are closed off by doors or door assemblies. Typically, the railroad cars are designed to have a floor and either one or two intermediate decks supported above the floor for holding the automobiles loaded thereon. The automobiles are driven from platforms at the end of the railroad car onto either the floor or a deck for loading.

The height of the railroad car is a critical matter. Due to limitations (underpasses, tunnels and the like) along the railway, the overall car height is restricted. Especially, in the case of a railroad car designed for three levels, i.e., having two decks supported above the floor, the total height of each automobile is limited by the height of the roof above the floor and by the distance between decks. A savings of two or three inches can be of great significance.

A number of end closure (door) designs are known for railroad cars of the type being discussed. Usually, the door assemblies slide from a closed position to a position along the inside of the side walls on a suitable guide track or rail that is provided adjacent the bottom edges of the door assemblies. The guide rail does not hinder the operation of the door assemblies but rather provides security by restricting their outward movement. Thus, access may not be gained to the railroad car interior by pulling the bottom edges of a door assembly out and away from an end opening.

The guide tracks or rails of the prior art extend upwardly from the floor at the end of the railroad car. This extension, undesirably, takes two or three inches away from the effective distance between floor and intermediate deck of the railroad car. Actually, where it is necessary to bridge the rail with a platform or the like, the floor to deck distance is even further diminished.

It is an advantage according to this invention to provide a railroad car adapted to carry automobiles having end closures with a door bottom guide system that does not diminish the effective distance between floor and intermediate deck of the railroad car while maintaining the security of its contents. A similar result has been achieved, in a pending U.S. application. In Ser. No. 783,943, filed Oct. 3, 1985, a continuous, uninterrupted door guide rail for a railroad car is provided with two depressible, spring-biased rail sections. These rail sections depress into recesses in the railroad car floor when automobile tires travel over them during loading and unloading.

SUMMARY OF THE INVENTION

Briefly, there is provided an improved railroad car arranged to transport automobiles. The railroad car comprises a floor, a roof, and a pair of spaced side walls.

At least one door assembly and means for guiding the door assembly are positioned adjacent an end opening of the railroad car to enable the loading and unloading of automobiles thereon. A rail for securing the lower end of the door assembly is positioned along the floor of the railroad car. Extensions attached to the door assembly contact with and straddle the rail along the floor and are in sliding engagement therewith.

The improvement according to the invention is that the rail positioned along the floor of the car has two interrupted portions through which the tires of an automobile pass during loading and unloading. Means for aligning the door assembly extensions onto the rail after they pass through an interrupted portion during opening and closing are positioned at both ends of each interrupted portion. Preferably, each aligning means comprises a pair of rail segments attached to the floor of the railroad car and spaced at an angle towards the rail and away from the interrupted portions. Most preferably, each aligning means protrudes partially beyond the rail and into said interrupted portions.

A means for securing the lower end of each door assembly when in a closed position is also provided. The securing means of the preferred embodiment includes a pin attached to a lower end of each door assembly, an aperture in the rail car floor intermediate each interrupted portion and correspondingly sized to receive the pin, and means for effecting relative movement between the pin and the aperture in the railroad car floor. Alternatively, a metal wedge may be substituted for the pin and a correspondingly sized slit for the aperture.

The improvement of this invention teaches a railroad car having no floor rail over which automobile tires must pass during loading and unloading. The improvement provides an alternative to the previously mentioned depressible rail section assembly of the pending U.S. application. In the latter assembly, there is always a possibility that the depressible rail portion might be accidentally inverted during assembly or be otherwise rendered inoperative. With the presently disclosed door bottom guide system, there is no possibility of causing damage to the tires of an automobile during loading and unloading. Although the floor rail is removed at the interrupted portions, the movement of the door assemblies is not affected and the contents of the railroad car nevertheless remain secure.

BRIEF DESCRIPTION OF THE DRAWINGS

Further features and other objects and advantages of this invention will become clear from the following detailed discussion made with reference to the drawings in which.

DESCRIPTION OF THE PREFERRED EMBODIMENTS

Referring now to FIGS. 1 through 4, there is shown the end of a railroad car designed to carry automobiles. The railroad car includes a frame 1 upon which is positioned a floor 2. For simplicity, the wheels and axles of the railroad car are not shown. Side walls 3, 4 rise from the floor 2 and are spaced apart the width of the railroad car. A roof, also not shown, spans the space between side walls 3, 4. Tube sections t are welded in pairs to the edges of floor 2 or frame 1. These tube sections form the fixed portion of hinges which, together with a rod and intermediate tube section, temporarily align and secure bridge platforms to the railroad car. These platforms are used for the loading and unloading of automobiles.

Figures 1, 5:
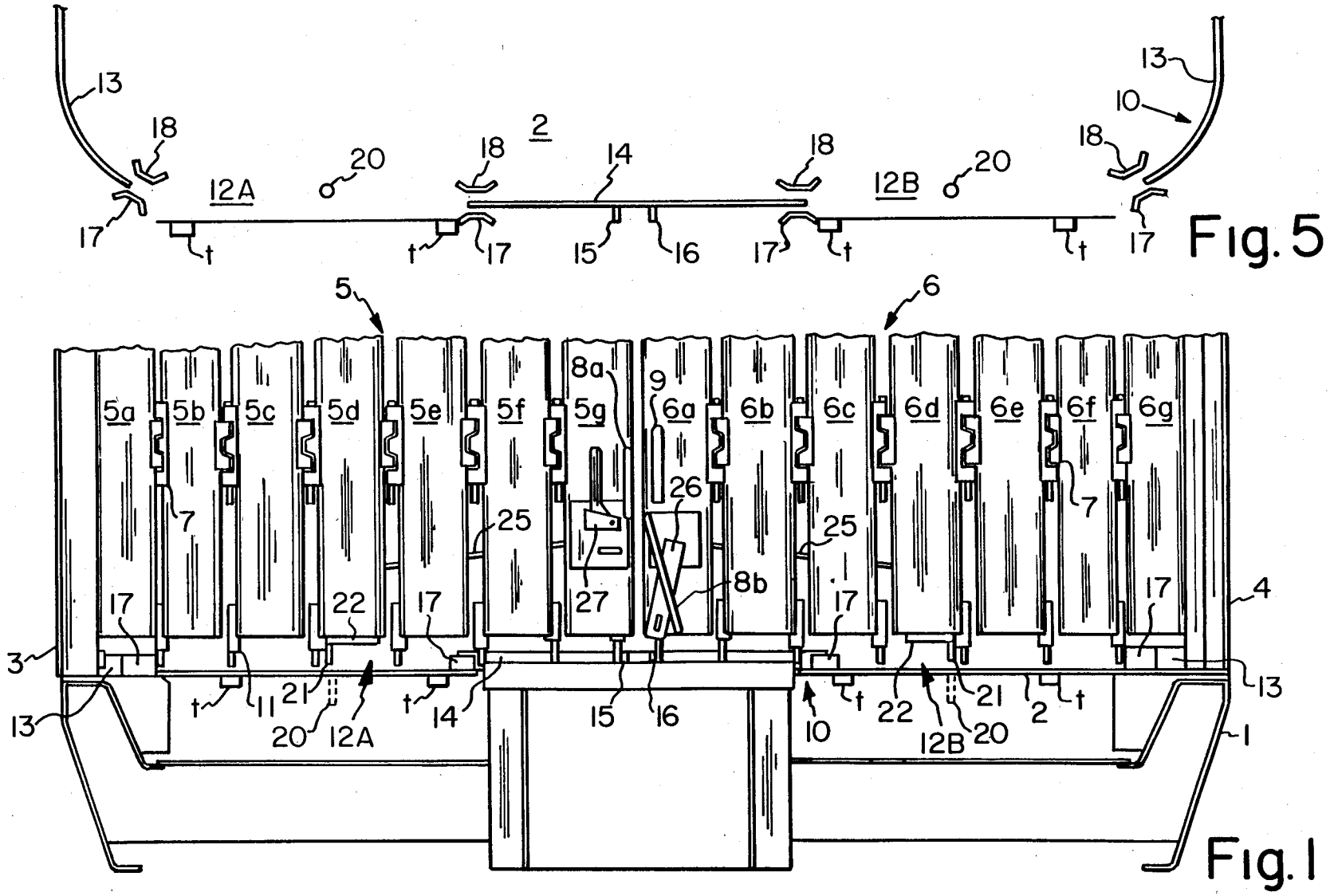
FIG. 1 is an end view of a portion of a railroad car exterior above the frame with securing means in an open position.
FIG. 5 is a plan view of the end of the railroad car shown in FIG. 1 with door assemblies removed.
Figure 2:
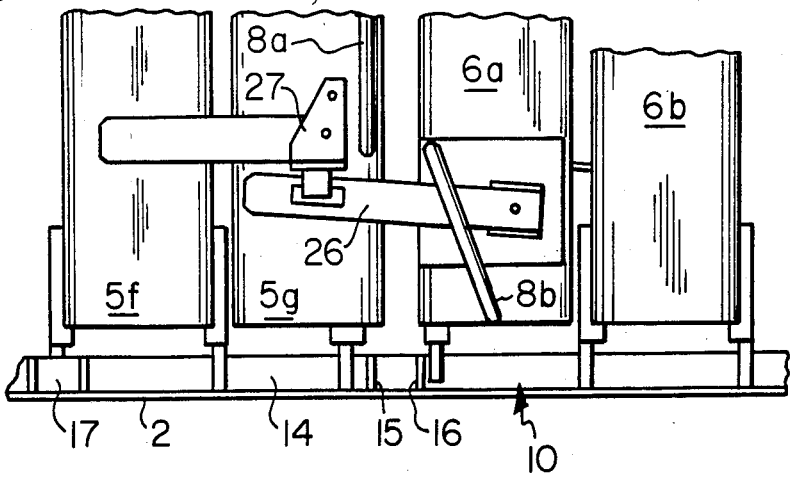
FIG. 2 is an elevation view of the railroad car exterior with securing means in a closed position.

Door assemblies 5, 6 are arranged to close off the end opening of the railroad car. Alternatively, a single door assembly may be used at one or both ends of the car. Door assemblies 5, 6 are arranged to slide back along the inside of side walls 3, 4 to an open or stowed position. As shown in FIG. 1, each door assembly comprises a plurality of long, thin upright sections, 5*a* through 5*g*; 6*a* through 6*g*. These sections are hinged together at the top, middle and bottom of the door by a pin and hinge assembly 7. The door assembly sections may be made of rigid, steel channels or any other suitable material.

Door assemblies 5, 6 are brought together to the center of the railroad car for closing and securement during transport. Handles 8*a*, 8*b* are used for this purpose. Once joined together, door assemblies 5, 6 may be further secured by any interlocking door mechanism known in the art such as the latch shown at 9. The support member, not shown, from which the door assemblies are hung for sliding between closed and open positions is generally arranged midway between the floor and the roof. Various roof configurations and support members have been designed depending upon the type of door assembly used. The particular construction of roof and support member form no part of this invention, however.

With the type of door assembly described above, there is provided a guide track or rail, generally 10. A plurality of extensions 11 are attached to the lower edges of each door assembly. These extensions 11 contact with and straddle rail 10 and are in sliding engagement therewith. Rail 10 acts as a means for securing the contents of the railroad car. Where the extensions straddle the rail, the lower edges of the door assemblies cannot be forced outwardly and away from an end opening. This prevents unauthorized access to the railroad car interior.

In a typical prior art railroad car, the rail would extend uninterrupted from side to side of the railroad car along the edges of the floor. Because of the presence of rail in areas over which automobile tires pass, the effective floor to deck distance of the car is undesirably diminished by two or three inches. It is a primary object of this invention to eliminate this waste of car height. Hence, rail 10 of the invention, as best seen in FIG. 5, has two interrupted portions 12A, 12B through which the tires of an automobile may pass. Preferably, interrupted portions 12A, 12B are spaced from a hypothetical center line of the railroad car an equal distance such that the tires will easily clear the remaining portions of rail 10 when the hypothetical center of the automobile is aligned with the center line of the railroad car during loading and unloading. The remaining rail is therefore divided into a pair of side rail sections 13, and center rail section 14. Most preferably, center rail section 14 further includes a pair of door rail stops 15, 16. These stops may protrude outwardly from one or both sides of the rail.

When the door assemblies of the railroad car according to the invention are closed or opened, several of the extensions 11 that are attached to the lower end of door assemblies 5, 6 will pass through interrupted portions 12A, 12B. These extensions 11 become temporarily derailed. To facilitate movement of the door assemblies, means for aligning extensions 11 onto rail 10 are provided at both ends of the interrupted portions. Each aligning means comprises a pair of rail segments 17, 18 that are attached to floor 2 at precise locations. Segment 17 is positioned outside the area of the car defined by rail 10, while segment 18 is within the railroad car interior. Together, segments 17, 18 are spaced at angles towards the rail and away from the ends of interrupted portions 12A, 12B. The rail segments of the aligning means shown in FIG. 5 protrude partially beyond the rail and into the interrupted portions of the railroad car floor. This serves to more easily channel extensions 11 back onto side and center rail sections, 13 and 14, respectively.

Preferably, segments 17, 18 are positioned at about a 45° angle with the rail. Most preferably, the aligning means are angled away from rail 10 at opposite ends to give segments 17, 18 a rhomboidal appearance. This shape aids in the alignment of the extensions 11 from rail 10 and through segments 17, 18. Alternatively, the aligning means may be comprised of curved or arched sections of rail or any other suitable material.

Figure 3:
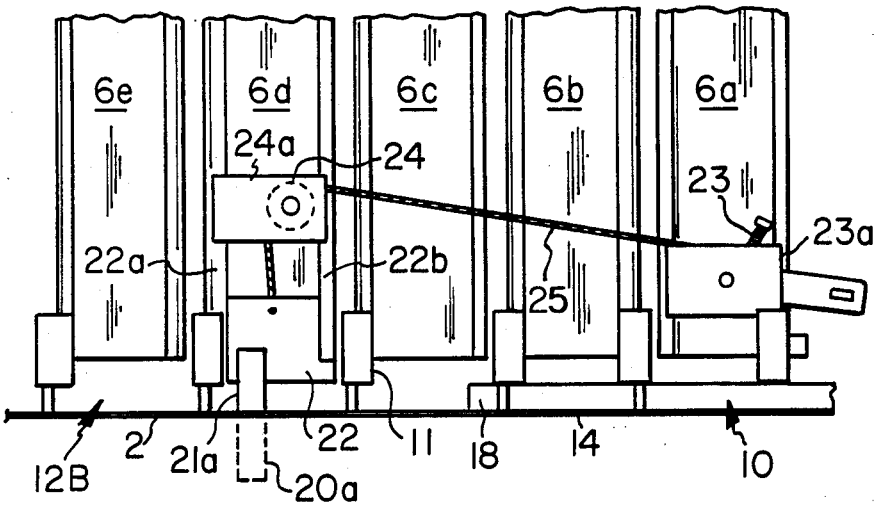
FIG. 3 is an elevation view from within the railroad car of an embodiment of securing means.
Figure 4:
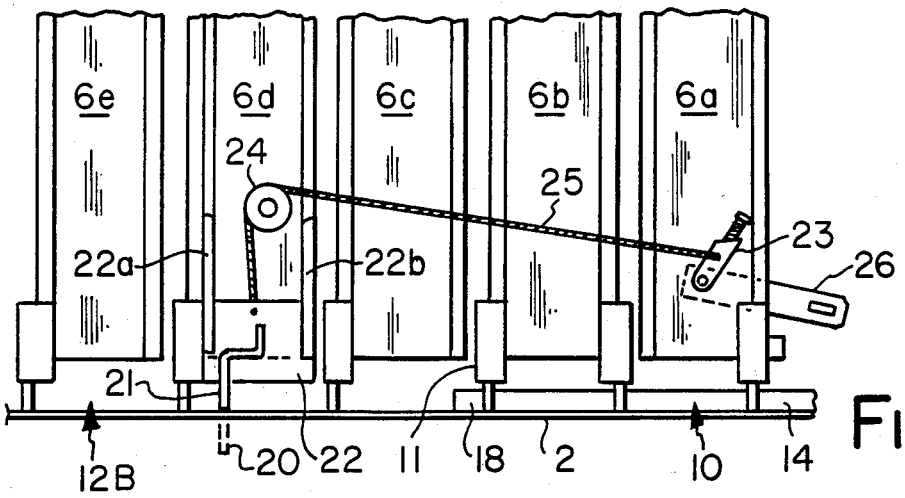
FIG. 4 is an elevation view from within the railroad car of an alternative embodiment of securing means.

When in their closed positions, door assemblies 5, 6 will have a tendency to move or rattle during transport due to this intentional omission of rail at interrupted portions 12A, 12B. In order to eliminate this problem and in order to prevent the door assemblies from being lifted outwardly and away from the end opening, the railroad car door guide system of the invention provides means for securing the lower ends of door assemblies 5, 6 at their respective interrupted portions. With reference to FIGS. 4 and 5, the securing means of door assembly 6 comprises an aperture 20 in floor 2 intermediate interrupted portion 12B. Aperture 20, shown in phantom in FIG. 1, is correspondingly sized to receive pin 21 when the door assemblies are brought together for closing. In an alternative embodiment shown in FIG. 3, a metal wedge 21*a* is substituted for pin 21 and a correspondingly sized slit, shown in phantom at 20*a*, replaces aperture 20. In either case, the pin or wedge is attached to plate 22 and postioned between channels 22*a*, 22*b* at the bottom of door assembly 6*d* to restrict the relative vertical movement therebetween.

The securing means of the invention further comprises a means for effecting relative movement between aperture 20 and pin 21. As shown in FIGS. 3 and 4, one embodiment comprises a spring-loaded handle 23, pulley 24 and cable 25 for connecting plate 22 with handle 23. The above elements are all positioned within the railroad car interior. However, the securing means is engaged from outside the railroad car by the pivotal connection of handle 23 to latch 26. An equivalent securing means is attached to the interior of door assembly 5 and connects to outer latch 27. Preferably, latch 26 and outer latch 27 can be made to interconnect from the car exterior to provide even greater security. To better protect handle 23 and pulley 24 from tampering, denting or other damage, either or both may be shielded in the car interior by protective plating, as shown in FIG. 3 at 23*a* and 24*a*, respectively.

Having thus described the invention with the detail and particularity required by the Patent Laws, what is desired protected by Letters Patent is set forth in the following claims.

I claim:

1. In a railroad car arranged to transport automobiles, said railroad car comprising a floor, a roof, a pair of spaced side walls, at least one door assembly and means for guiding said door assembly to a position adjacent a side wall to enable loading and unloading of said railroad car, a rail for securing a lower end of said door assembly, said rail positioned along said floor of said railroad car, a plurality of extensions attached to said door assembly which contact with and straddle said rail and are in sliding engagement therewith, the improvement comprising:

said rail having two interrupted portions through which the tires of an automobile will pass during loading and unloading of said railroad car;

means for aligning said extensions which pass through said interrupted portions during opening and closing of said door assembly onto said rail; and means for securing said lower end of said door assembly at each of said interrupted portions when said door assembly is in a closed position.

2. The improvement as claimed in claim 1 wherein said interrupted portions are spaced from a hypothetical center line of said railroad car an equal distance such that the tires of an automobile will pass through said interrupted portions when a hypothetical center line of the automobile is aligned with the center line of said railroad car.

3. The improvement as claimed in claim 1 wherein each of said means for aligning said extensions onto said rail comprises a pair of rail segments attached to said floor of said railroad car, said rail segments being spaced at an angle towards said rail and away from said interrupted portions at each end of said interrupted portions.

4. The improvement as claimed in claim 3 wherein said pair of rail segments protrude partially beyond the rail and into said interrupted portions.

5. The improvement as claimed in claim 3 wherein said rail segments are positioned at about a 45° angle with said rail.

6. The improvement as claimed in claim 5 wherein said rail segments are angled away from said rail at opposite ends.

7. The improvement as claimed in claim 1 wherein said securing means comprises at least one pin attached to a lower end of each door assembly, an aperture in said floor of said railroad car intermediate said interrupted portion and correspondingly sized to receive said pin and means for effecting relative movement between said pin and said aperture.

8. The improvement as claimed in claim 1 wherein said securing means comprises at least one metal wedge attached to a lower end of each door assembly; a slit in said floor of said railroad car intermediate said interrupted portion and correspondingly sized to receive said metal wedge and means for effecting relative movement between said wedge and said slit.

* * * * *